US008827253B2

(12) United States Patent
Younger

(10) Patent No.: US 8,827,253 B2
(45) Date of Patent: Sep. 9, 2014

(54) HAND-STRUNG JEWELRY CONSTRUCTION BOARD

(76) Inventor: Sandra Younger, Carlsbad, CA (US)

( * ) Notice: Subject to any disclaimer, the term of this patent is extended or adjusted under 35 U.S.C. 154(b) by 518 days.

(21) Appl. No.: 13/031,185

(22) Filed: Feb. 19, 2011

(65) Prior Publication Data

US 2011/0204554 A1 Aug. 25, 2011

Related U.S. Application Data

(60) Provisional application No. 61/305,956, filed on Feb. 19, 2010.

(51) Int. Cl.

| | |
|---|---|
| ***B23Q 1/00*** | (2006.01) |
| ***B23Q 3/00*** | (2006.01) |
| ***B25B 11/00*** | (2006.01) |
| ***H01K 3/10*** | (2006.01) |
| ***B21F 3/00*** | (2006.01) |

(52) U.S. Cl.

USPC ..... 269/54; 140/92.1; 269/302.1; 269/289 R; 269/21; 269/900; 29/850

(58) Field of Classification Search

USPC ..... 269/289 R, 302.1, 21, 900; 29/896.4, 29/896.41, 896.411, 896.43, 896.42

See application file for complete search history.

(56) References Cited

U.S. PATENT DOCUMENTS

| | | | | |
|---|---|---|---|---|
| 4,724,612 | A * | 2/1988 | Pearson | 29/850 |
| 5,878,788 | A * | 3/1999 | Gurry | 140/92.1 |
| 6,250,619 | B1 * | 6/2001 | Cook et al. | 269/20 |
| 6,253,798 | B1 * | 7/2001 | Helwig | 140/92.1 |
| 6,932,336 | B1 * | 8/2005 | Nudo | 269/302.1 |
| 2003/0071406 | A1 * | 4/2003 | Sellers | 269/289 R |
| 2009/0039742 | A1 * | 2/2009 | Ripley, Jr. | 312/114 |
| 2009/0272148 | A1 * | 11/2009 | Jaykins | 63/3.1 |

* cited by examiner

*Primary Examiner* — Lee D Wilson
*Assistant Examiner* — Nirvana Deonauth
(74) *Attorney, Agent, or Firm* — John R. Ross; John R. Ross, III

(57) ABSTRACT

A hand-strung jewelry construction board. A plurality of holes is drilled into the board. One or more pins are inserted into the holes. Also, one or more clamps are inserted into the holes. A jewelry string is looped around the pins and clamped in position by the clamps. In a preferred embodiment, second and third strings are wrapped around the jewelry string adjacent the pins at each end of the jewelry string. The second and third wrapped strings are glued into place. When the jewelry string is removed from the jewelry construction board, permanent loops are formed into the jewelry string.

3 Claims, 9 Drawing Sheets

HAND-STRUNG JEWELRY CONSTRUCTION BOARD

This application claims the benefit of Provisional Application 61/305,956 filed Feb. 19, 2010, which is incorporated by reference herein. The present invention relates to tools for making necklaces and bracelets, and more in particular, to tools for producing knots in the stringing material of necklaces and bracelets.

BACKGROUND OF THE INVENTION

The makers of hand-strung jewelry routinely and consistently encounter a set of complexities that increase both the cost and time involved with manufacture. These include: (1) the need to affix or attach metallic "end caps" to each end of the stringing material of an item of strung jewelry enabling the ends to be connected to each other through the intermediary of a connecting device such as a clasp or other hooking device; (2) the need to accurately space tiered necklace strands so that they descend in a specific and orderly configuration when being worn; (3) the need to produce single and multi-strand lengths of stringing material of consistent length and tightness; (4) the need to consistently and uniformly affix and space knots along a length of stringing material to produce accurate spacing of beads or other attachments to the material; and, (5) the need to rigidly hold chain strands in place so as to uniformly space and consistently attach items such as beads, baubles, jump rings, or pendants.

The inability of hand-strung jewelry manufacturers to replace the use of "end caps" with knots significantly increases the cost of strung jewelry production because quality end caps are expensive. Furthermore, end caps often work loose over time causing potential loss of the strung jewelry items they are intended to secure. Also, prior art end caps are so ineffectively designed and poorly produced that they fail to adequately secure the stringing material resulting in jewelry breakage or loss. Also, prior art end caps are not available in a range of diameters/sizes suitable to the diameters/sizes of the stringing material(s) desired for use by the strung jewelry manufacturers. Also, prior art end caps are not available in an adequate variety of materials and colors to allow for the production of articles of strung jewelry as per the wishes of the designer or consumer.

What is needed is a device for making it easier to construct hand-strung jewelry.

SUMMARY OF THE INVENTION

The present invention provides a hand-strung jewelry construction board. A plurality of holes is drilled into the board. One or more pins are inserted into the holes. Also, one or more clamps are inserted into the holes. A jewelry string is looped around the pins and clamped in position by the clamps. In a preferred embodiment, second and third strings are wrapped around the jewelry string adjacent the pins at each end of the jewelry string. The second and third wrapped strings are glued into place. When the jewelry string is removed from the jewelry construction board, permanent loops are formed into the jewelry string.

DETAILED DESCRIPTION OF THE PREFERRED EMBODIMENTS

The present invention allows for inclusion of special knots at the terminal points of single- or multiple-strand jewelry items (such as necklaces, bracelets, anklets, etc.) for the purpose of fastening or securing them around the wearer's neck, wrist, ankle, etc., thereby eliminating the necessity of using additional, expensive materials in the form of end caps at the terminal points of said strands.

The present invention also provides an alternative solution to the necessity of limiting the desired specifications of hand-strung jewelry item designs as a result of the limited size range and availability of end caps for differing diameters or compositions of single- or multiple-strand jewelry items; further, to provide an alternative solution to the limitations on design that result from the limited range of color, design, and texture of end caps.

The present invention also allows one to rapidly produce accurately spaced tiered necklace strands of varying length and complexity so that they descend in a specific and orderly configuration when being worn.

The present invention also allows one to to rapidly and consistently produce specifically desired lengths of single- and multiple-strand necklaces from a variety of stringing materials (e.g., waxed cotton, silk, leather, hemp, nylon).

The present invention also allows one to consistently and uniformly produce variously spaced knots along a length of stringing material to guide the accurately spaced placement of beads, baubles, or other attachments to the material.

The present invention also allows one to provide rigid tension to various lengths of chain strands during the jewelry production process to allow for rapid and uniform spacing of desired attachments such as beads, baubles, jump rings, or pendants.

Board Design

Figure 1:
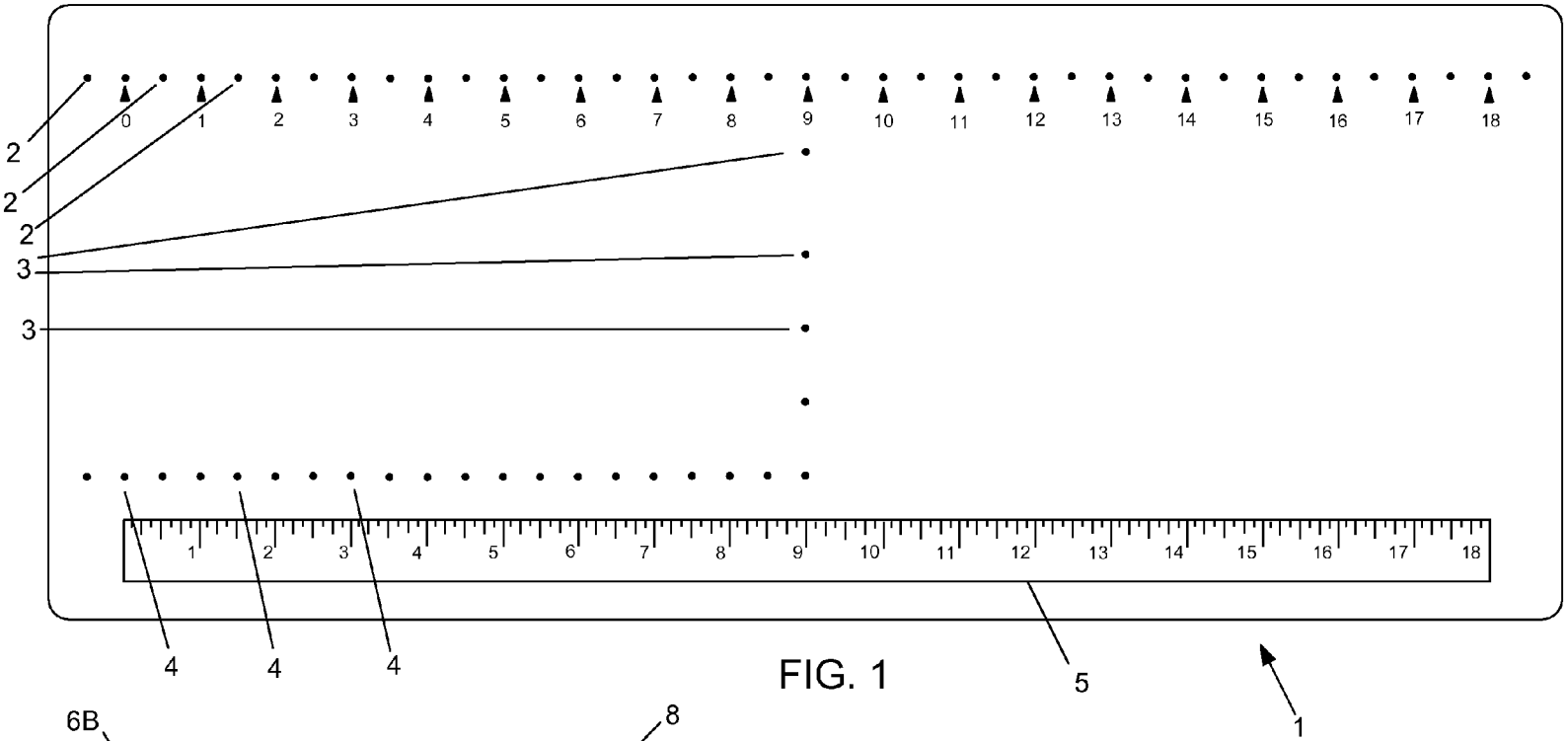
FIGS. 1-1B show a preferred embodiment of the present invention.

FIG. 1 shows a preferred embodiment of the present invention. Board 1 is approximately 20"×8"×¾". There are numerous holes 2, 3 and 4 drilled approximately ⅝" deep and ⅛" in diameter into board 1.

Holes 2 extend along a row ½ inch down from the top edge of the board and are separated by approximately ½". Preferably, holes 2 are marked at 1-inch intervals to extend from 0"-18" as shown.

Holes 3 are arranged in a column and are perpendicular to holes 2. The top hole 3 is approximately 1 inch below the row formed by holes 2. The second hole 3 is 1¼" below the top hole 3. The third hole 3 is approximately 1 inch below the second hole 3. The final hole 3 is also 1 inch downward.

Holes 4 extend along the lower edge of board 1 and form a row that is parallel to the row formed by holes 2 and that is perpendicular to the column formed by holes 3. Preferably there are twenty holes 4 and they are separated by approximately ½ inch.

Ruler 5 is printed onto board 1 and extends approximately 18½ inches along the bottom edge of board 1 and below the row formed by holes 4.

Method and Procedures for Making Necklaces and/or Bracelets

Multistrand Necklace

Figure 1B:
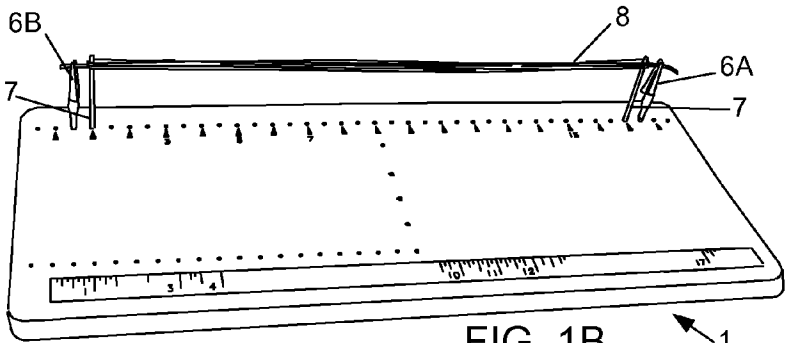

A preferred procedure for making a multistrand necklace is shown in FIGS. 1-13. In FIG. 1B, clamps 6A and 6B and pins 7 have been inserted into board 1 as shown. String 8 is first clamped at clamp 6A and then wrapped multiple times around pins 7. In one preferred embodiment string 8 is wrapped 5 times around pins 7. When the user is finished wrapping string 8 around pins 7, he clamps the string tight using clamp 6B.

Figure 2:
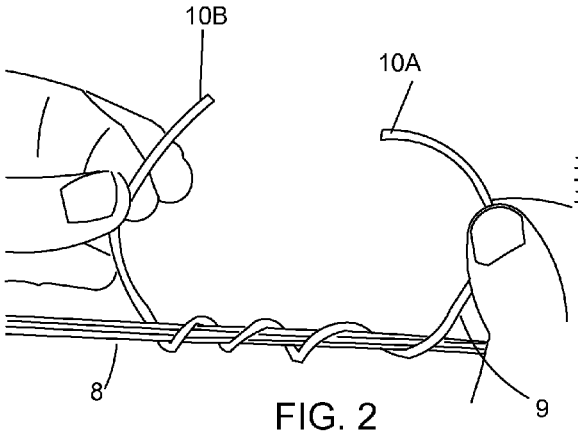
FIGS. 2-14 show a preferred method for making a permanent loop.
Figure 3:
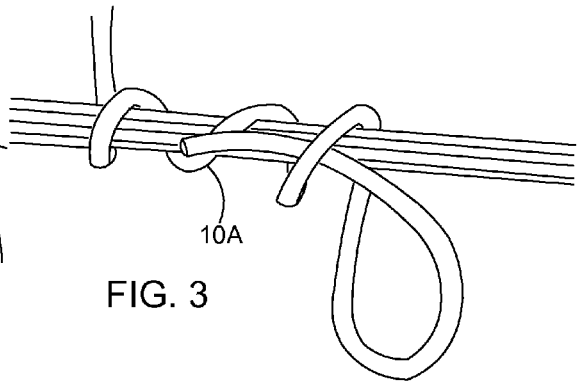
Figure 4:
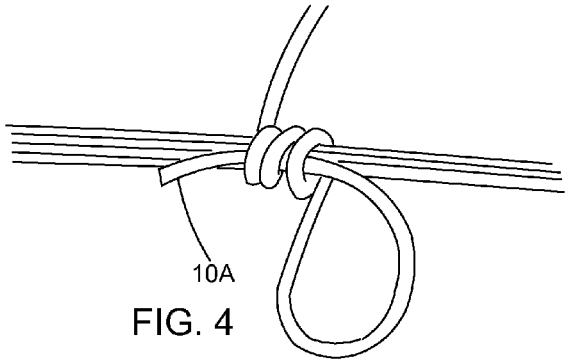
Figure 5:
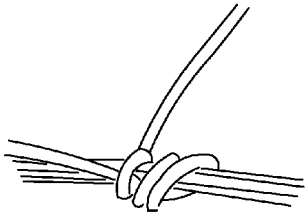
Figure 6:
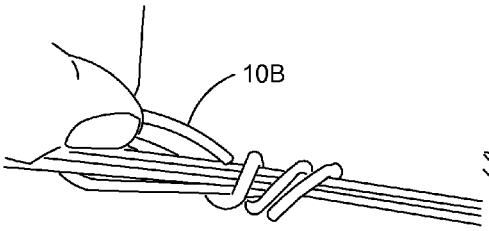
Figure 7:
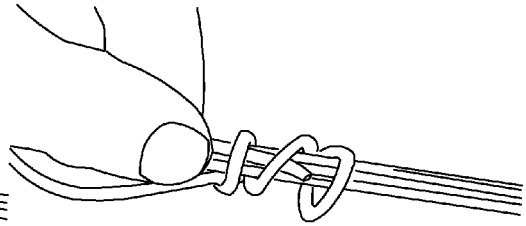
Figure 8:
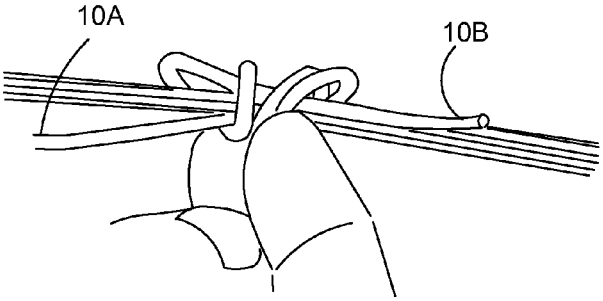
Figure 9:
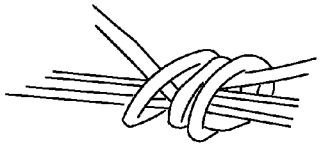
Figure 10:
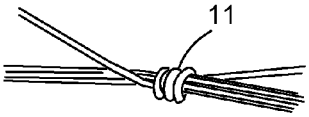
Figure 11:
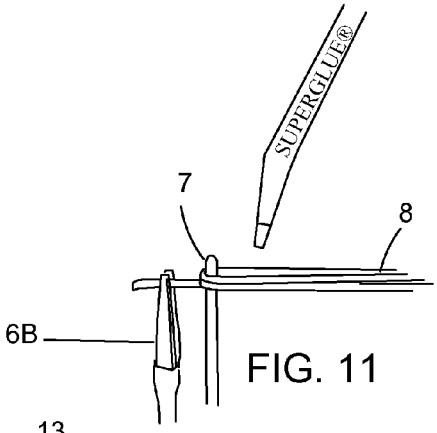
Figure 12:
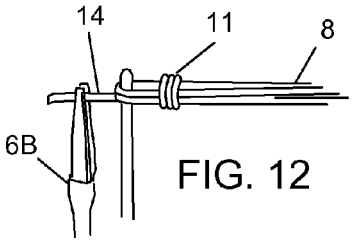
Figure 13:
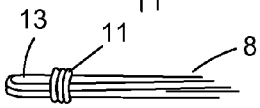
Figure 14:
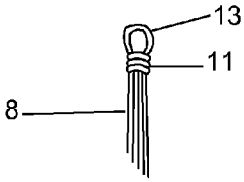

In FIG. 2 the user has cut string 9 approximately 10 inches long and has wrapped it around the taught strands of string 8 as shown. In FIGS. 2-5 the user is inserting string end 10A through the loops of string 9. In FIGS. 6-8 the user is inserting string end 10B through the loops of string 9. In FIG. 9 the user is pulling string ends 10A and 10B tight to form knot 11 (FIG. 10). In FIG. 11 the user is putting a drop of superglue on the strands of string 8 adjacent pin 7. In FIG. 12 the user has slipped slip knot 11 so that it is positioned over the superglue drop on strands of string 8. The user then cuts off extra string end 14. FIGS. 13 and 14 show a perfectly formed loop 13 at the end of knot 11. The same procedure can be repeated on the other side of the necklace so that the necklace has two loops 13, one at each end.

The user can then attach a clasp or metallic loop onto loops 13 if he desires.

Closed Loop Attachment

Figure 15:
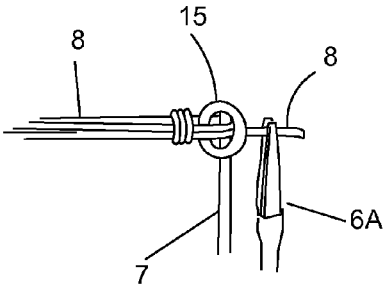
FIGS. 15-16 show a preferred closed metal loop attached.
Figure 16:
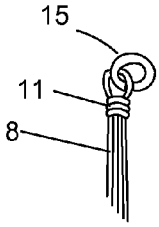

It is also possible to form loops 13 with a closed metal loop attached. For example, FIG. 15 shows a view similar to that shown in FIG. 12. However, closed metal loop 15 has been place adjacent to pin 7. Sting 8 has been threaded through closed metal loop 15 when the string was wrapped around pins 7 as shown in FIG. 1B. The steps described above are followed. Finally, in FIG. 16, the user has glued slip knot 11 such that it forms a loop that attaches closed metal loop 15 as shown.

Staggered Length Necklace

Figure 17:
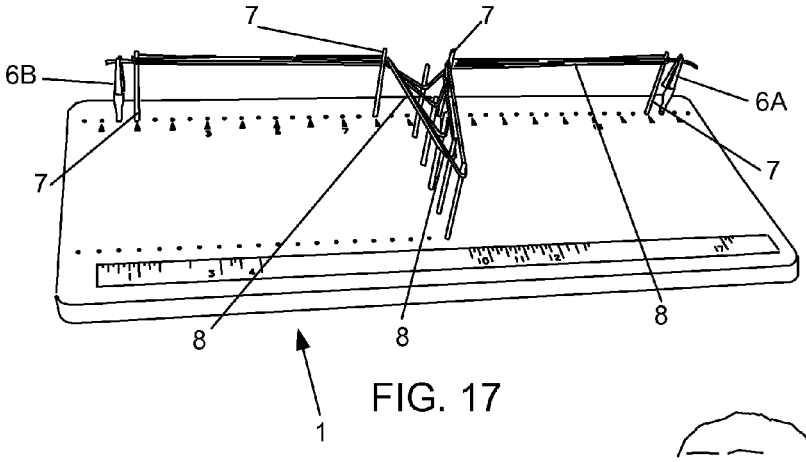
FIGS. 17 and 18 show a preferred method for making and wearing a staggered length necklace.
Figure 18:
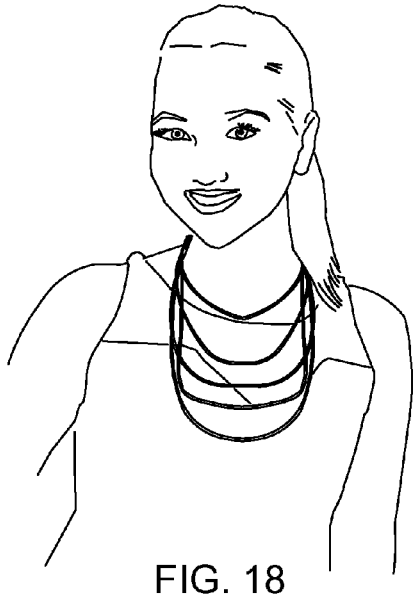

It is also possible to make a necklace having strands of staggered length. FIG. 17 shows board 1 with pins 7 inserted as shown. In FIG. 17 the user has threaded string 8 through pins 7 as shown and has clamped both ends of string 8 with clamps 6A and 6B. To form the necklace the user ties and then glues slip knots 11 onto both ends of the necklace to form loops in a manner similar to that described above. FIG. 18 shows the necklace with strands having staggered length.

Single Strand Necklace

Figure 19:
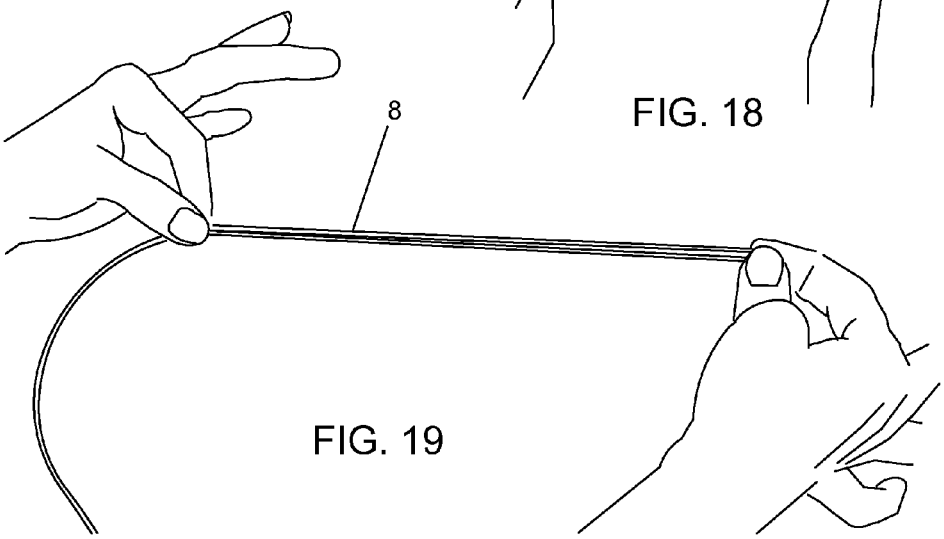
FIGS. 19-26 show s preferred method for making a single strand necklace.
Figure 20:
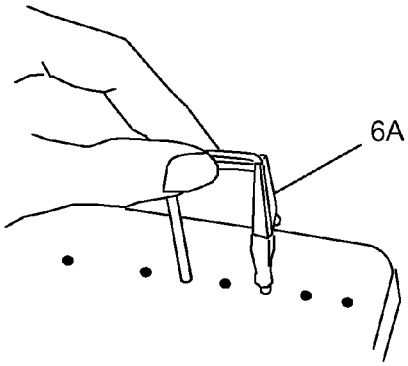
Figure 21A:
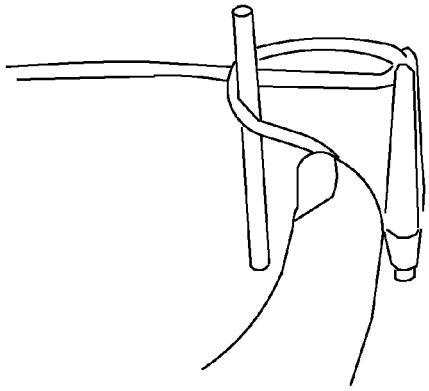
Figure 21B:
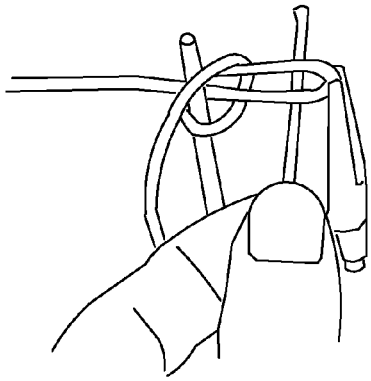
Figure 22A:
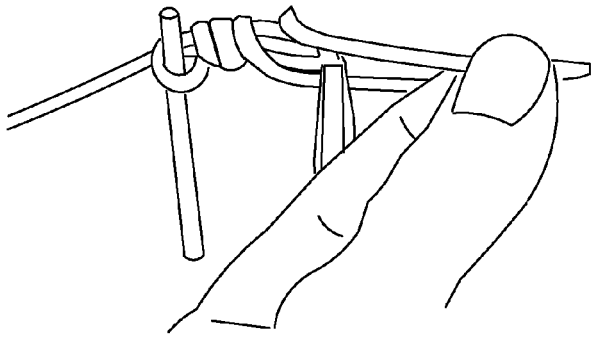
Figure 22B:
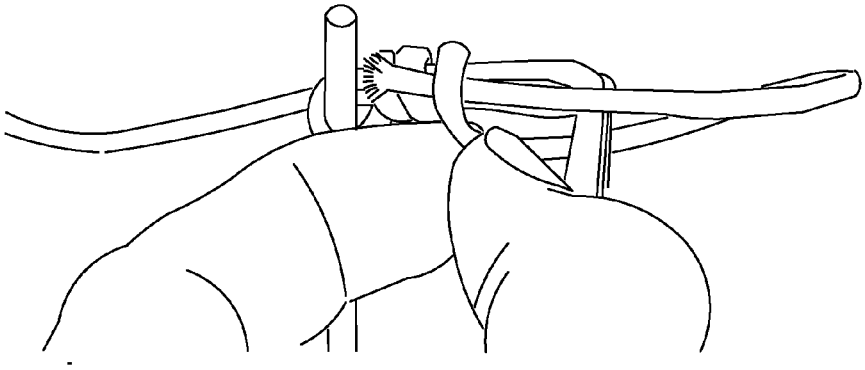
Figure 23:
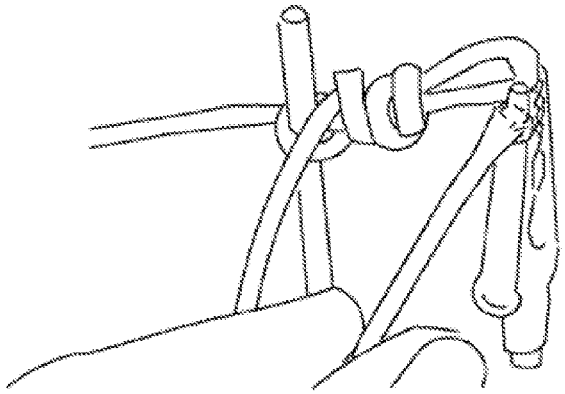
Figure 23B:
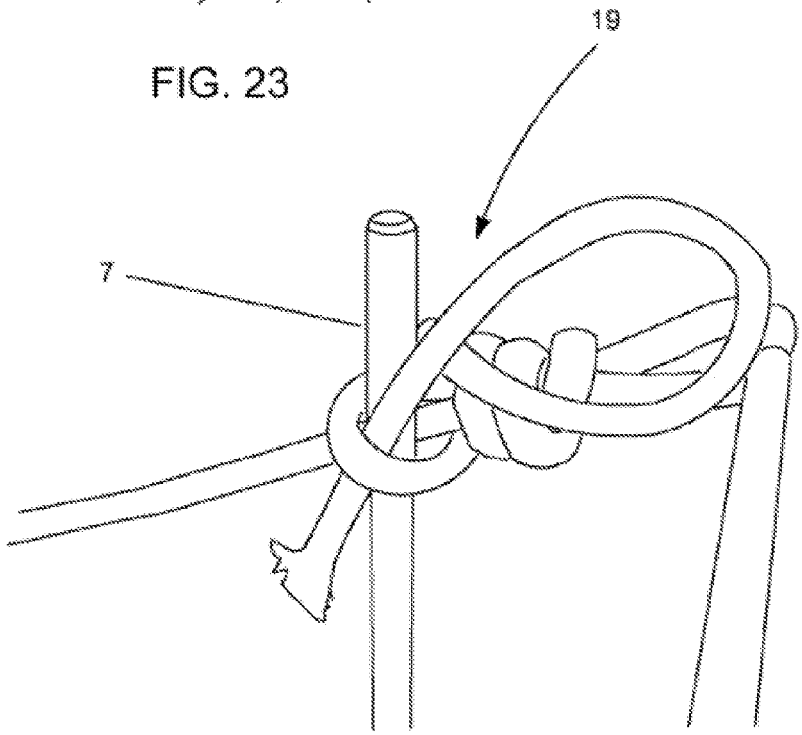
Figure 24:
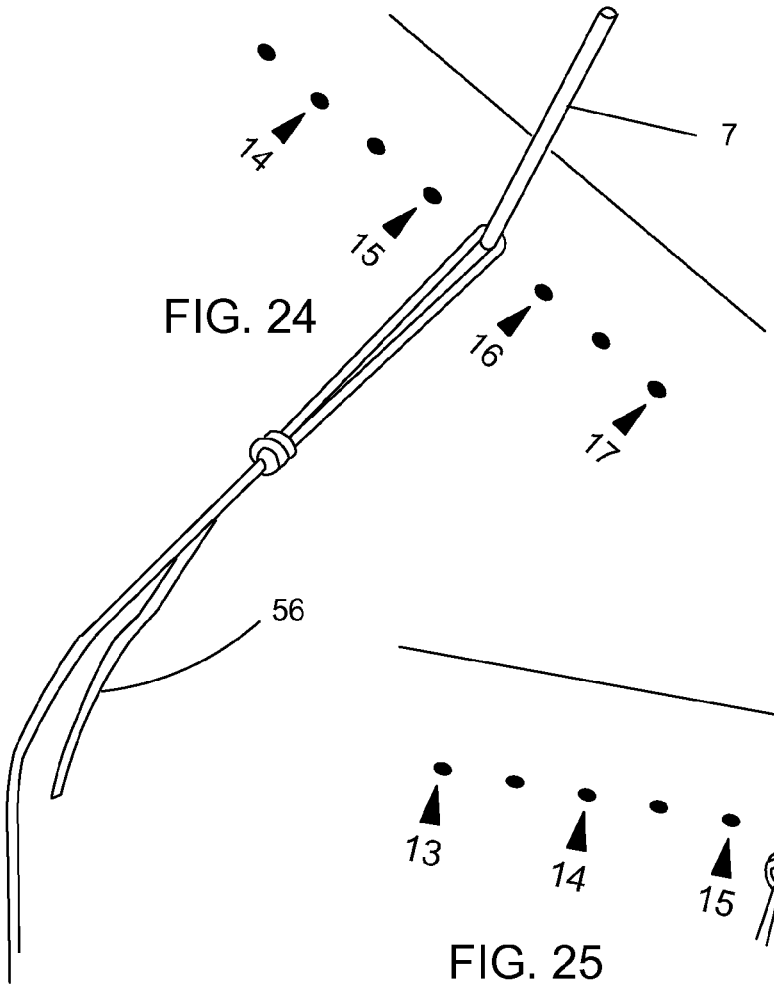
Figure 25:
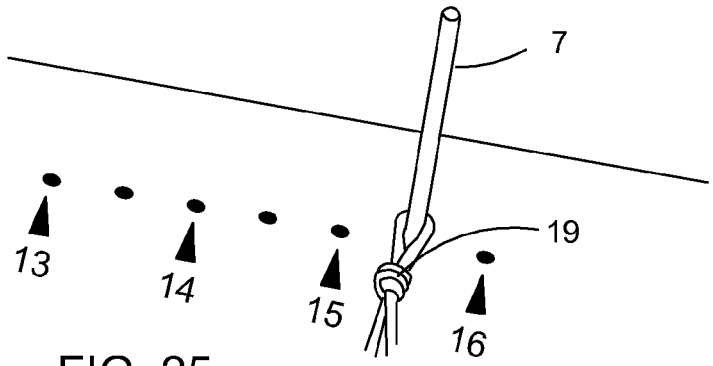
Figure 26:
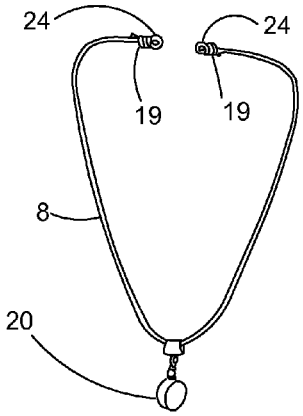

FIGS. 19-26 show a preferred procedure for fabricating a single strand necklace. In the example shown, the user wants to make a 15 inch necklace. She firsts cut a 30 inch section of string 8. Utilizing ruler 5 (FIG. 1), she measures and then creates a 10 inch loop section (FIG. 19). She then attaches the tip of the loop to clamp 6A and then wraps string 8 around pin 7 and ties slip knot 19 adjacent to pin 7 (FIGS. 20-23B). The loop is then pulled free from clamp 6A and looped over pin 7 (FIG. 24). The user pulls on short end 56 (FIG. 24) and slip knot 19 is then slid tight against pin 7 (FIG. 25). Superglue is then put over slip knot 19 to hold it in place. String 8 is then pulled up from pin 7 so that small loop 24 is formed by slip knot 19 (FIG. 26). Pendant 20 is then threaded through string 8 until it is stopped by slip knot 19. A similar procedure is followed to form a second slip knot 19 on the other end of string 8.

Other Preferred Uses

Chain Holder

Figure 27:
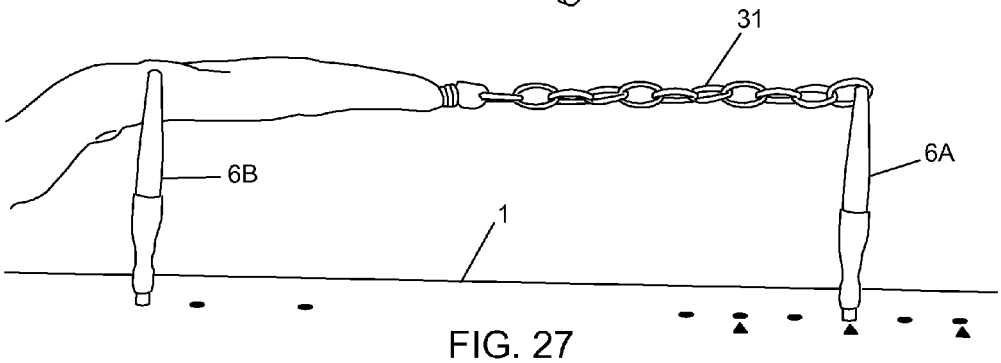
FIG. 27 shows a preferred method for using the present invention as a chain holder.
Figure 28:
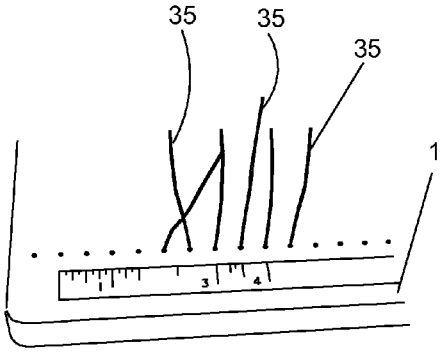
FIG. 28 shows a preferred method for using the present invention as a jewelry item holder.

In FIG. 27 clamps 6A and 6B have been inserted into holes in board 1 and chain 31 has been stretched tight between clamps 6A and 6B. The user is now able to easily attach items to chain 31 as desired for decoration.

Holes as Item Holder

In FIG. 30 necklace items 35 have been inserted into holes 4 for easy retrieval by the user.

Glass Cutter

Figure 29:
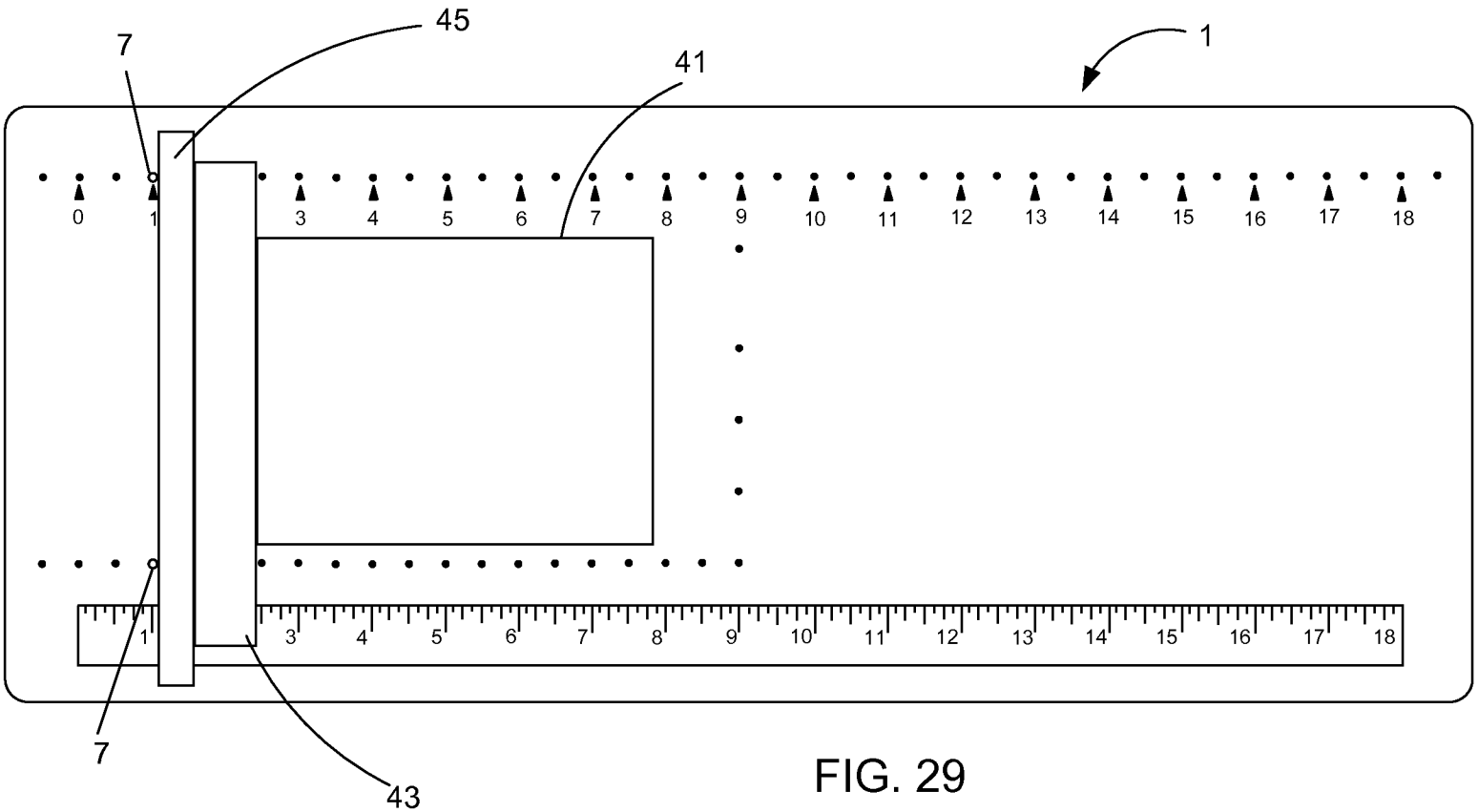
FIG. 29 shows a preferred method for using the present invention as a glass cutter.

FIG. 29 illustrates how board 1 can be utilized as a glass cutter. For example, pins 7 are inserted into holes 2 and 4 as shown. Guide 45 is laid on board 1 and pressed tight against pins 7. Glass piece 41 is then also laid on board 1 and pressed up against guide 45. Cutting guide 43 is then laid on top of glass piece 41 and pushed up against guide 45. The user can then easily cut glass piece 41 by running the cutting blade along the edge of cutting guide 43.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A process for making hand-strung jewelry utilizing a construction board having dimensions of at least 20 inches by 8 inches, said at least 20 inches dimension defining a top edge and a bottom edge, and said at least 8 inches defining a width and having at least 10 pin holes spread approximately linearly in the 20 inches dimension along the top edge of the board and at least four pin holes spread approximately linearly approximately in the center of the board approximately perpendicular to a line defined by the at least 10 holes, said process comprising the steps of:

A) inserting a pin in each of the at least two pins holes of said at least 10 pin holes said inserted pins defining at least two loop pins, B) inserting an alligator clamp in at least two pin holes of said at least 10 pin holes, C) looping a jewelry string multiple times around said at least two loop pins to define a multiple strand jewelry element, D) clamping each end of said jewelry string with the two alligator clamps, E) wrapping a separate string around the multiple strand jewelry element at locations near each of the at least two pins and forming a knot in each of said separate strings so as to define an end loop at each of two ends of said multiple strand jewelry element, F) applying glue to each of said knots to prevent untying of the knots, and G) attaching a clasp to at least one of the end loops.

2. A process for making hand-strung jewelry utilizing a jewelry construction board having a plurality of pin holes, said process comprising the steps of:

A) inserting a pin in each of the at least two pins holes of said plurality of pin holes, said inserted pins defining at least two loop pins, B) inserting a clamp in at least two pin holes of said plurality of pin holes, C) looping a jewelry string multiple times around said at least two loop pins to define a multiple strand jewelry element, D) clamping each end of said jewelry string with the two clamps, E) wrapping a separate string around the multiple strand jewelry element at locations near each of the at least two pins and forming a knot in each of said separate strings so as to define an end loop at each of two ends of said multiple strand jewelry element, F) applying glue to each of said knots to prevent untying of the knots, and G) attaching a clasp to at least one of the end loops.

3. The process as in claim 2, wherein said clamp is an alligator clamp.

* * * * *